US009013357B2

(12) United States Patent
He et al.

(10) Patent No.: US 9,013,357 B2
(45) Date of Patent: Apr. 21, 2015

(54) MOBILE BROADBAND DEVICE

(75) Inventors: Jinjun He, Shenzhen (CN); Bin Zhang, Shenzhen (CN); Yaming Jiang, Wuhan (CN)

(73) Assignee: Huawei Device Co., Ltd., Shenzhen (CN)

( * ) Notice: Subject to any disclaimer, the term of this patent is extended or adjusted under 35 U.S.C. 154(b) by 430 days.

(21) Appl. No.: 13/455,262

(22) Filed: Apr. 25, 2012

(65) Prior Publication Data

US 2012/0212377 A1 Aug. 23, 2012

Related U.S. Application Data

(63) Continuation of application No. PCT/CN2010/078100, filed on Oct. 26, 2010.

(30) Foreign Application Priority Data

Oct. 26, 2009 (CN) ..... 2009 2 0246276 U

(51) Int. Cl.
*H01Q 1/24* (2006.01)
*H01Q 1/22* (2006.01)
*H01Q 9/42* (2006.01)

(52) U.S. Cl.
CPC ..... *H01Q 1/2275* (2013.01); *H01Q 1/243* (2013.01); *H01Q 9/42* (2013.01); *H01Q 5/371* (2015.01)

(58) Field of Classification Search
CPC ..... H01Q 1/24; H01Q 1/38; H01Q 9/0421; H01Q 1/244; H01Q 1/242
USPC ..... 343/702, 906; 455/89, 90
See application file for complete search history.

(56) References Cited

U.S. PATENT DOCUMENTS 6,437,745 B1 * 8/2002 Vaisanen et al. ..... 343/702
6,518,927 B2 * 2/2003 Schremmer et al. ..... 343/702

(Continued)

FOREIGN PATENT DOCUMENTS

CN 2544422 4/2003
CN 2554877 6/2003

(Continued)

OTHER PUBLICATIONS

Extended European Search Report mailed Nov. 7, 2013 in corresponding European Application No. 10826070.4.

(Continued)

*Primary Examiner* — Huedung Mancuso
(74) *Attorney, Agent, or Firm* — Staas & Halsey LLP

(57) ABSTRACT

The present invention provides a mobile broadband device, and relates to the field of communications technologies. The mobile broadband device includes a casing, a Printed Circuit Board Assembly (PCBA), and an antenna. The antenna and the PCBA are both set in the casing, and the PCBA can be slidably pulled out or retracted back along the casing. The antenna is fixedly set on an inner side of the casing and forms a hollow space for accommodating the retracted PCBA, there is a contact point set on the antenna, and the contact point is electrically connected to a feed point of the PCBA. With the mobile broadband device, the antenna does not individually occupy part of space in the casing without affecting the performance of the antenna; therefore, the volume and length of the mobile broadband device are effectively reduced, and the portability of the mobile broadband device is effectively improved.

14 Claims, 3 Drawing Sheets

(56) References Cited

U.S. PATENT DOCUMENTS

| | | | | |
|---|---|---|---|---|
| 6,639,563 | B1 | 10/2003 | Gu | |
| 2006/0131431 | A1 | 6/2006 | Finn | |
| 2008/0165067 | A1 * | 7/2008 | Kim | 343/702 |
| 2012/0212377 | A1 | 8/2012 | He et al. | |

FOREIGN PATENT DOCUMENTS

| | | | |
|---|---|---|---|
| CN | 101425617 | | 5/2009 |
| CN | 101459706 | A | 6/2009 |
| CN | 201549585 | | 8/2010 |
| GB | 2449910 | | 12/2008 |
| JP | 2005-217190 | | 8/2005 |
| JP | 2007165965 | | 6/2007 |
| JP | 3146612 | | 11/2008 |
| WO | 00/01028 | | 1/2000 |
| WO | 03/067703 | A1 | 8/2003 |
| WO | 2005/120164 | A2 | 12/2005 |

OTHER PUBLICATIONS

Notice of Reasons for Rejection, dated Jun. 25, 2013, in corresponding Japanese App. No. 2012-535610 (11 pp.)

International Search Report of Corresponding PCT Application PCT/CN/2010 mailed Dec. 30, 2010.

International Search Report issued Dec. 30, 2010 in corresponding International Patent Application No. PCT/CN2010/078100.

Written Opinion of the International Searching Authority issued Dec. 30, 2010 in corresponding International Patent Application No. PCT/CN2010/078100.

English abstract of Chinese Reference 254422, published Apr. 9, 2003.

English abstract of Chinese Reference 2554877, published Jun. 4, 2003.

English abstract of British Reference 2449910, published Dec. 10, 2008.

* cited by examiner

MOBILE BROADBAND DEVICE

CROSS-REFERENCE TO RELATED APPLICATIONS

This application is a continuation of International Application No. PCT/CN2010/078100, filed on Oct. 26, 2010, which claims priority to Chinese Patent Application No. 200920246276.2, filed on Oct. 26, 2009, both of which are hereby incorporated by reference in their entireties.

FIELD OF THE INVENTION

The present invention relates to the field of communications technologies, and in particular, to a mobile broadband device.

BACKGROUND OF THE INVENTION

A mobile broadband product may be connected to a computer to enable a computing device (computer, personal digital assistant, and various mobile terminals) to realize mobile network access. Because data transmission is performed through radio signals, the mobile broadband product generally has a built-in antenna. The antenna is fixedly electrically connected to a Printed Circuit Board Assembly (PCBA), and always individually occupies a considerably large part of space in the mobile broadband product to ensure the performance of the antenna.

A general layout of an antenna in a conventional mobile broadband product is as shown in FIG. 1. Generally, an antenna 2 is individually set on an end of a casing of the mobile broadband product, and is set in parallel to a PCBA in the casing of the mobile broadband product, so that the antenna 2 is not shielded by a PCBA 1, thus protecting the performance of the antenna. Because the antenna individually occupies a considerably large part of space, the volume of the mobile broadband products with this structure cannot be reduced, which affects the portability.

SUMMARY OF THE INVENTION

Embodiments of the present invention provide a mobile broadband device, so as to enable a mobile broadband device to have a small volume and good portability without affecting performance of an antenna.

An embodiment of the present invention provides a mobile broadband device, including a casing, a PCBA, and an antenna.

The antenna and the PCBA are set in the casing, and the PCBA can be slidably pulled out or retracted back along the casing. The antenna is fixedly set on an inner side of the casing and forms a hollow space for accommodating the retracted PCBA. There is a contact point set on the antenna, and the contact point is electrically connected to a feed point of the PCBA.

An embodiment of the present invention further provides a mobile broadband device, including a casing, a PCBA, and an antenna.

The antenna and the PCBA are both set inside a cavity of the casing, and the PCBA is slidably connected to the casing.

An interface component is fixed at an end of the PCBA, an interface hole is opened at an end of the casing, and the interface component and the interface hole are located at a same end of the mobile broadband device.

The antenna is fixedly set on an end of the casing, and the antenna and the interface hole are respectively at two opposite ends of the casing. There is a contact point set on the antenna, there is a feed point set on the PCBA, and the contact point of the antenna is electrically connected to the feed point of the PCBA.

The cavity of the casing is configured to accommodate the PCBA and electrical components set on the PCBA, and a shape of the cavity of the casing matches a shape of the PCBA; when the PCBA slides along the casing, the interface component can extend out of the interface hole or be retracted back into the cavity of the casing, where the electrical components include the interface component.

It can be seen from the technical solutions according to the embodiments of the present invention that, in the embodiments of the present invention, the antenna is set on an inner wall of the casing and forms a hollow space for accommodating the retracted PCBA, so that when the mobile broadband product is in a non-use state, a part of the PCBA retracted back into the casing can be placed in the hollow space of the antenna. Thus, the antenna does not individually occupy a part of space in the casing, and the volume of the mobile broadband device is effectively reduced. A part of the PCBA is pulled out from the casing while in use, so that the PCBA is pulled out from the hollow space of the antenna. Thus, the performance of the antenna in the casing is not affected in use.

BRIEF DESCRIPTION OF THE DRAWINGS

To illustrate the technical solutions according to the embodiments of the present invention or in the prior art more clearly, accompanying drawings required for describing the embodiments or the prior art are introduced below briefly. Apparently, the accompanying drawings in the following descriptions are merely some embodiments of the present invention, and persons of ordinary skill in the art may further obtain other drawings according to the accompanying drawings without creative efforts.

DETAILED DESCRIPTION OF THE EMBODIMENTS

For ease of understanding, the technical solutions according to the embodiments of the present invention are clearly and completely described in the following with reference to the accompanying drawings in the embodiments of the present invention. Obviously, the embodiments to be described are merely part of rather than all of the embodiments of the present invention. All other embodiments obtained by persons of ordinary skill in the art based on the embodiments of the present invention without creative effects shall fall within the protection scope of the present invention.

Embodiment 1

Figure 1:
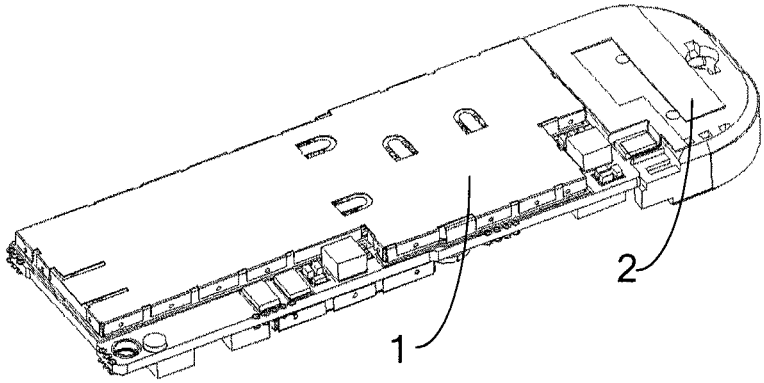
FIG. 1 is a schematic structural diagram of a mobile broadband product in the prior art.
Figure 2:
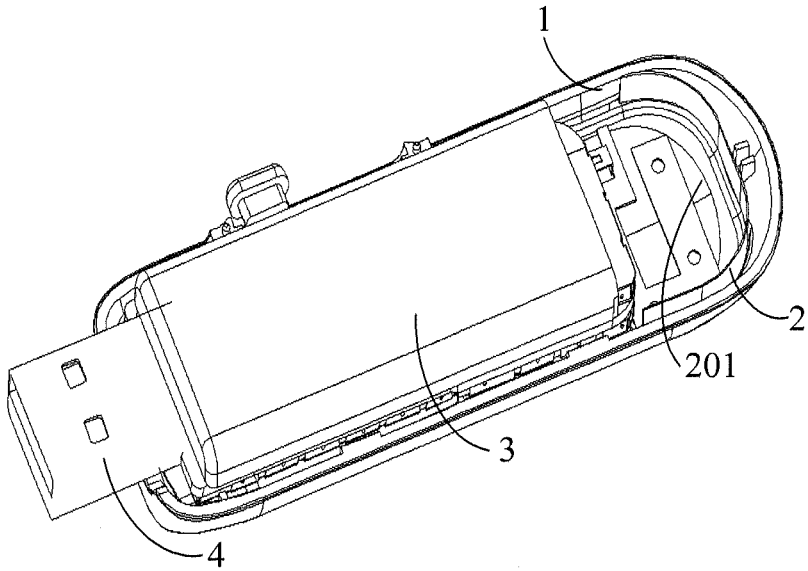
FIG. 2 is a schematic structural diagram of a mobile broadband device according to an embodiment of the present invention.
Figure 3:
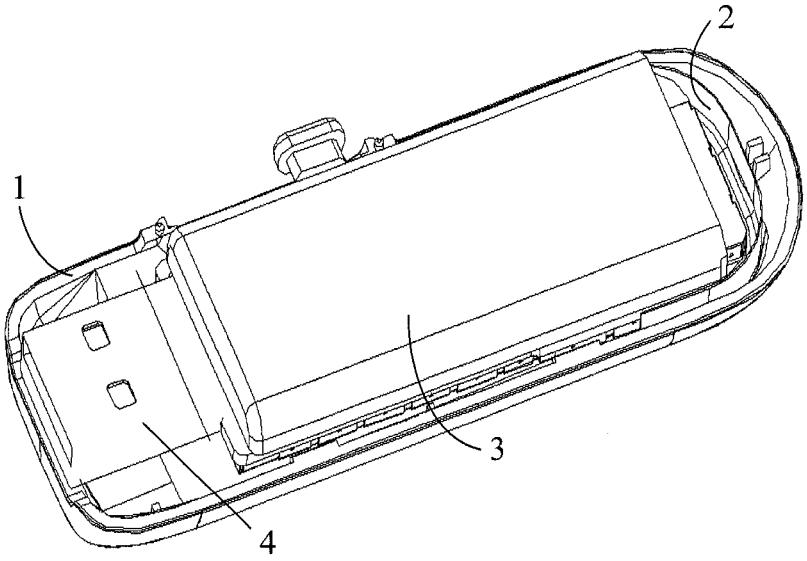
FIG. 3 is a schematic diagram of a mobile broadband device in a non-use state according to an embodiment of the present invention.

This embodiment provides a mobile broadband device, which is applicable in a computer product to realize mobile broadband connection. As shown in FIG. 2 and FIG. 3, the mobile broadband device includes:

a casing 1, a PCBA 3, and an antenna 2.

The antenna 2 and the PCBA 3 are both set in the casing 1, the PCBA 3 includes a Printed Circuit Board (PCB) and various electrical components set on the PCB, the various electrical components on the PCBA 3 are connected to form a hardware structure for realizing the mobile broadband connection, the PCBA 3 can be slidably pulled out or retracted back along the casing 1; the antenna 2 is fixedly set on an inner side of the casing 1 and forms a hollow space 201 for accommodating the retracted PCBA 3, there is a contact point 223 set on the antenna 2 (referring to FIG. 4), and the contact point 223 is electrically connected to a feed point 31 (referring to FIG. 5) of the PCBA 3.

Figure 4:
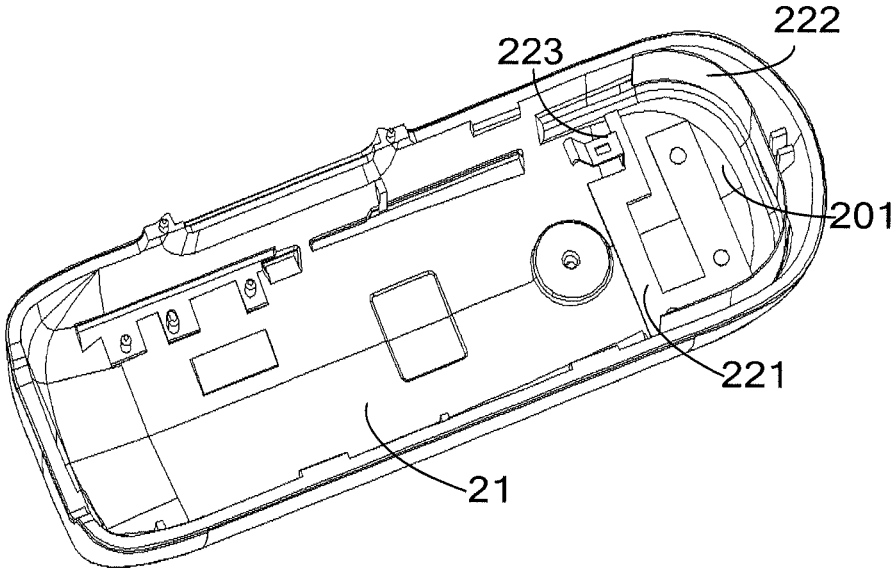
FIG. 4 is a schematic diagram of installation of an antenna of a mobile broadband device according to an embodiment of the present invention.

In the foregoing mobile broadband device, the antenna 2 may be a flexible antenna or a metal antenna, specifically, a side of the antenna is closely adhered to and is fixedly set on a top end of the inner wall of the casing, and a top end of the antenna is set on a top end of the casing in a surrounding manner to form a hollow space. FIG. 4 shows an example of the structure of the antenna. A side of the antenna has a flat structure 221, a top end of the antenna has a strip structure 222, the flat structure 221 is closely adhered to and is set on an inner wall at the top end of the casing 1, the flat structure 221 is electrically connected to the strip structure 222, the strip structure 222 is set on the top end of the casing 1, and the strip structure 222 has an arc shape and forms a hollow space 201. It can be known that, FIG. 4 is an example of the structure of the antenna, a side of the antenna may have a shape that is set according to the internal form of the casing and can be closely adhered to the inner wall of the casing for the convenience of being fixed in the casing, rather than a flat structure 221; similarly, the top end of the antenna may have a shape that the top end of the antenna is perpendicular to or approximately perpendicular to the inner part that fixes the top end of the antenna inside the casing for the convenience of forming a hollow space, rather than a strip structure 222. Therefore, according to the embodiment of the present invention, the structure of the antenna may have various forms, as long as the antenna is fixedly set in the casing, does not individually occupy the space, and forms a hollow space for accommodating the retracted PCBA.

Figure 5:
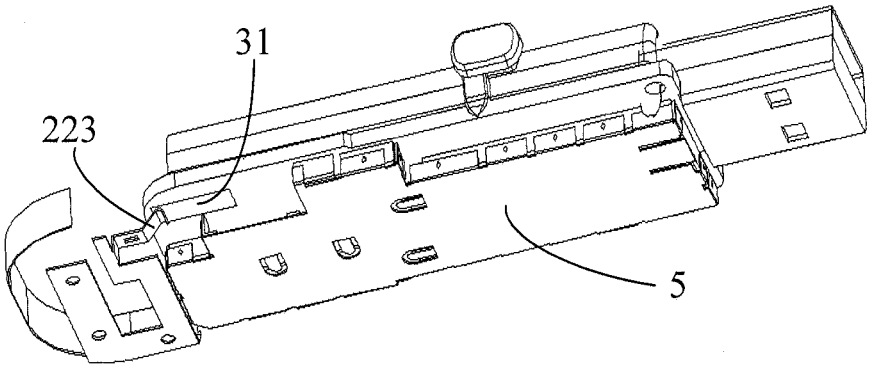
FIG. 5 is a schematic diagram of connection of a PCBA and an antenna of a mobile broadband device according to an embodiment of the present invention.

As shown in FIG. 5, the contact point 223 of the antenna 2 may be an elastic metal body, and the elastic metal body is slidably connected to the feed point 31 of the PCBA 3 in an elastic manner. In practice, there may be a limiting clamp set on the casing, there may also be a positioning clamp set on the PCBA, and the positioning clamp on the PCBA corresponds to the limiting clamp on the casing. In this way, when the PCBA is slidably pulled out or retracted back, the limiting clamp on the casing may ensure that the PCBA slides in a certain range, thus well maintaining the electrical connection of the feed point 31 of the PCBA 3 and the contact point 223 of the antenna 2.

In the foregoing mobile broadband device, the antenna is closely adhered to and is fixedly set on the inner side of the casing, and the antenna forms a hollow space, so that when the mobile broadband device is in a non-use state, the PCBA may be retracted back into the hollow space of the antenna, thus effectively reducing the volume and shortening the length of the entire mobile broadband device; when the mobile broadband device is in a use state, the PCBA may be slidably pulled out from the casing, so that the PCBA is pulled out from the hollow space formed by the antenna in the casing. At this time, the contact point of the antenna and the feed point of the PCBA are in electrical conduction, so that the performance of the antenna is not affected in use.

Embodiment 2

This embodiment provides a mobile broadband device, which is applicable in a computer product to realize mobile broadband connection. The mobile broadband device may be a wireless modem, such as a USB data card. As shown in FIG. 2 and FIG. 3, the mobile broadband device includes:

a casing 1, a PCBA 3, and an antenna 2.

The casing may be a cuboid or have a strip shape similar to a cuboid, the casing may include two or more shells, and the two or more shells are connected to each other to form a cavity; the antenna 2 and the PCBA 3 are both set in the cavity of the casing 1, the PCBA 3 is slidably connected to the casing, and the antenna 2 is fixed on an inner wall of the cavity of the casing 1.

The PCBA 3 includes a PCB and various electrical components set on the PCB, such as a USB interface 4, an electromagnetic shield 5, and a processor; the various electrical components on the PCBA 3 are connected to form a hardware structure for realizing the mobile broadband connection, the USB interface 4 is set on an end of the PCBA 3, the casing has an interface hole opened on a position corresponding to the USB interface 4, the interface hole is located at an end of the casing 1, the USB interface 4 and the interface hole are located at a same end of the mobile broadband device; the PCBA 3 is capable of sliding along the casing 1, and when the PCBA 3 slides along the casing 1, the USB interface 4 can extend out of the interface hole or be retracted back into the cavity of the casing 1.

The antenna 2 and the interface hole are set on two opposite ends of the casing 1 respectively, a shape of the antenna 2 matches a shape of an inner wall of the cavity of the casing 1, there is a contact point 223 (referring to FIG. 4) set on the antenna 2, and the contact point 223 is electrically connected to a feed point 31 (referring to FIG. 5) of the PCBA 3.

It should be noted that, when the USB interface 4 is retracted back into the cavity of the casing 1, as shown in FIG. 3, the PCBA 3 is placed in the cavity of the casing 1, at this time, in at least one projection direction perpendicular to a sliding direction of the PCBA 3, the projection of the PCBA 3 on the inner wall of the cavity of the casing 1 partially or completely coincides with the projection of the antenna 2 on the inner wall of the cavity of the casing 1. When the USB interface 4 extends out of the interface hole, as shown in FIG. 2, the PCBA 3 vacates a part of the space 201 in the cavity at the end where the antenna 2 in the casing 1 is located, at this time, on the foregoing projection direction, the projection of the antenna 2 mostly or completely does not coincide with the projection of the PCBA 3, and the USB interface 4 extending out of the interface hole may be inserted into a USB interface slot of a computer, and the mobile broadband device may perform data transmission with the computer through the USB interface 4.

In the mobile broadband device, the antenna 2 may be a flexible antenna or a metal antenna. The antenna 2 may include at least two parts, for example, a first part of the antenna is closely adhered to and is fixedly set on a side surface of the inner wall of the cavity at an end portion of the casing, a second part of the antenna is set on an end surface of the inner wall of the cavity at the end portion of the casing in a surrounding manner, and the second part forms a hollow space, or the first part and the second part together form a hollow space. FIG. 4 shows an example of the structure of the antenna. A first part of the antenna 2 has a flat structure 221, a second part of the antenna 2 has a strip structure 222, the flat structure 221 is closely adhered to and is set on a side surface of an inner wall at an end portion of the casing 1, the flat structure 221 is electrically connected to the strip structure 222, the strip structure 222 is set on an end surface of the inner wall of the cavity at an end portion of the casing 1, and the strip structure 222 has an arc shape and forms a hollow space 201 together with the flat structure 221. It can be known that, FIG. 4 is an example of the structure of the antenna. The first part of the antenna may have a shape that is set according to the internal form of the casing and can be closely adhered to the side surface of the inner wall of the casing for the convenience of being fixed in the casing, rather than a flat structure 221, and the second part of the antenna may have a shape that is set according to the internal form of the casing and can be closely adhered to the end surface of the inner wall of the casing for the convenience of being fixed in the casing, rather than a strip structure 222. Therefore, according to the embodiment of the present invention, the structure of the antenna may have various forms, as long as the antenna is fixedly set in the casing, and the shape of the antenna is adaptive to the shape of the inner wall of the cavity of the casing, at this time, the antenna does not individually occupy the space, and forms a hollow space for accommodating the retracted PCBA.

The end portion of the casing refers to a top surface of the cuboid or strip casing and a part of the side surfaces close to and around the top; the side surface of the inner wall of the end portion of the casing refers to the inner wall of a part of the side surfaces of the end portion of the casing, the end surface of the inner wall of the end portion of the casing refers to the inner wall of the top surface of the end portion of the casing.

As shown in FIG. 5, the contact point 223 of the antenna 2 may be an elastic metal body, and the elastic metal body is slidably connected to the feed point 31 of the PCBA 3 in an elastic manner. In practice, there may be a limiting clamp set on the casing, there may also be a positioning clamp set on the PCBA, and the positioning clamp on the PCBA corresponds to the limiting clamp on the casing. In this way, when the PCBA is slidably pulled out or retracted back, the limiting clamp on the casing may ensure that the PCBA slides in a certain range, thus well maintaining the electrical connection of the feed point 31 of the PCBA 3 and the contact point 223 of the antenna 2.

In the foregoing mobile broadband device, the antenna is closely adhered to and is fixedly set on the inner wall of the casing, and the antenna forms a hollow space, so that when the mobile broadband device is in a non-use state, the PCBA may be retracted back into the hollow space of the antenna, thus effectively reducing the volume and shortening the length of the entire mobile broadband device; when the mobile broadband device is in a use state, the USB interface set on the PCBA may be slidably pulled out from the casing, so that the PCBA is pulled out from the hollow space formed by the antenna in the casing. At this time, the contact point of the antenna and the feed point of the PCBA are in electrical conduction, so that the performance of the antenna is not affected in use.

To sum up, according to the embodiments of the present invention, the antenna is set on the inner side of the casing and forms a hollow space, so that when the mobile broadband device is in a non-use state, the PCBA may be retracted back into the hollow space of the antenna, the length of the entire mobile broadband device is shortened by about 10 mm, so that the volume of the mobile broadband product is greatly reduced and the portability is significantly improved.

The foregoing descriptions are merely exemplary embodiments of the present invention, but not intended to limit the protection scope of the present invention. Any variation or replacement made by persons skilled in the art within the technical scope of the present invention shall fall within the protection scope of the present invention. Therefore, the protection scope of the present invention is subject to the appended claims.

What is claimed is:

1. A mobile broadband device, comprising:

a casing, a Printed Circuit Board Assembly (PCBA), and an antenna;

wherein the antenna and the PCBA are both set in the casing, the PCBA is capable of being slidably pulled out or retracted back along the casing, a contact point being set on the antenna to electrically be connected to a feed point of the PCBA;

wherein the antenna is fixedly set on a side surface of an inner wall of a cavity of the casing and the antenna substantially surrounds an entire end surface of the inner wall of the cavity of the casing, and the antenna forms a hollow space such that when an interface component is retracted back into the cavity of the casing, the hollow space accommodates the PCBA.

2. The mobile broadband device according to claim 1, wherein the antenna is a flexible antenna or a metal antenna.

3. The mobile broadband device according to claim 1, wherein the contact point of the antenna is an elastic metal body.

4. The mobile broadband device according to claim 1, wherein the contact point of the antenna is slidably connected to the feed point of the PCBA in an elastic manner.

5. The mobile broadband device according to claim 1, wherein a limiting clamp is set on the casing, a positioning clamp is set on the PCBA, and when the PCBA is placed into the casing, the positioning clamp on the PCBA corresponds to the limiting clamp on the casing.

6. The mobile broadband device according to claim 1, wherein the antenna comprises:

a first part fixedly set on the side surface of the inner wall of the cavity of the casing, and a second part set on the end surface of the inner wall of the cavity of the casing in a surrounding manner, and the PCBA is accommodated into the hollow space formed by the first part and the second part.

7. A mobile broadband device, comprising:

a casing, a Printed Circuit Board Assembly (PCBA), and an antenna;

wherein the antenna and the PCBA are both set inside a cavity of the casing, and the PCBA is slidably connected to the casing;

an interface component is fixed at an end of the PCBA, an interface hole is opened at an end of the casing, and the interface component and the interface hole are located at a same end of the mobile broadband device;

the antenna is fixedly set on an end of the casing, the antenna and the interface hole are respectively at two opposite ends of the casing, a feed point set on the PCBA, and a contact point being set on the antenna to electrically be connected to the feed point of the PCBA; and the cavity of the casing is configured to accommodate the PCBA and electrical components set on the PCBA, and a shape of the cavity of the casing matches a shape of the PCBA; when the PCBA slides along the casing, the interface component can extend out of the interface hole or be retracted back into the cavity of the casing, wherein the electrical components comprise the interface component;

wherein the antenna is fixedly set on a side surface of an inner wall of the cavity of the casing, and the antenna substantially surrounds an entire end surface of the inner wall of the cavity of the casing, and the antenna forms a hollow space such that when the interface component is retracted back into the cavity of the casing, the hollow space accommodates the PCBA.

8. The mobile broadband device according to claim 7, wherein the antenna is a flexible antenna or a metal antenna.

9. The mobile broadband device according to claim 7, wherein the contact point of the antenna is an elastic metal body.

10. The mobile broadband device according to claim 7, wherein the contact point of the antenna is slidably connected to the feed point of the PCBA in an elastic manner.

11. The mobile broadband device according to claim 7, wherein a limiting clamp is set on the casing, a positioning clamp is set on the PCBA, when the PCBA is retracted back into the cavity of the casing, the positioning clamp on the PCBA cooperates with the limiting clamp on the casing to enable the PCBA to slide in a range limited by the limiting clamp.

12. The mobile broadband device according to claim 7, wherein the antenna comprises:

a first part fixedly set on the side surface of the inner wall of the cavity of the casing, and a second part set on the end surface of the inner wall of the cavity of the casing in a surrounding manner, and the PCBA is accommodated into the hollow space formed by the first part and the second part.

13. The mobile broadband device according to claim 7, wherein the interface component is a USB interface, and the mobile broadband device is a wireless modem.

14. The mobile broadband device according to claim 12, wherein the first part of the antenna has a flat structure, and the second part of the antenna has a strip structure.

* * * * *